US009761947B2

(12) United States Patent
Yang

(10) Patent No.: US 9,761,947 B2
(45) Date of Patent: Sep. 12, 2017

(54) ANTENNA OSCILLATOR STRUCTURE

(71) Applicant: SHENZHEN ANTOP TECHNOLOGY CO., LTD, Shenzhen, Guangdong (CN)

(72) Inventor: Ruidian Yang, Shenzhen (CN)

(73) Assignee: SHENZHEN ANTOP TECHNOLOGY CO., LTD., Shenzhen (CN)

( * ) Notice: Subject to any disclaimer, the term of this patent is extended or adjusted under 35 U.S.C. 154(b) by 87 days.

(21) Appl. No.: 14/626,142

(22) Filed: Feb. 19, 2015

(65) Prior Publication Data

US 2015/0236423 A1 Aug. 20, 2015

(30) Foreign Application Priority Data

Feb. 20, 2014 (CN) ..... 2014 2 0073699 U

(51) Int. Cl.
*H01Q 9/04* (2006.01)
*H01Q 7/00* (2006.01)
*H01Q 9/26* (2006.01)

(52) U.S. Cl.
CPC ..... *H01Q 9/0407* (2013.01); *H01Q 7/00* (2013.01); *H01Q 9/26* (2013.01)

(58) Field of Classification Search
CPC ..... H01Q 9/0407; H01Q 9/26; H01Q 7/00
See application file for complete search history.

(56) References Cited

U.S. PATENT DOCUMENTS

2007/0120742 A1* 5/2007 Soler Castany ..... H01Q 9/26 343/700 MS

* cited by examiner

*Primary Examiner* — Dieu H Duong
*Assistant Examiner* — Michael Bouizza
(74) *Attorney, Agent, or Firm* — Pearne & Gordon LLP

(57) ABSTRACT

A flattened antenna oscillator structure has a square frame with an opening in the middle of a lower side. Two vertical oscillator leads parallel to left and right sides are symmetrically arranged inside the frame. Lower ends of the vertical oscillator leads extend into the opening to form feeder contacts. The left and right sides of the frame have plural inward extending matching leads connected with the vertical oscillator leads. The pair of leads at the uppermost end is connected with the upper ends of the vertical oscillator leads. The layout of the antenna oscillator improves the anti-deformation ability of a whole antenna while combining different frequency bands and different frequencies, which improves the signal reception and receiving quality of the antenna oscillator. A variety of modulation structures are further arranged to maximize the receiving power of the antenna and reduce the loss caused by mutual interference between signals.

10 Claims, 5 Drawing Sheets

ANTENNA OSCILLATOR STRUCTURE

FIELD OF INVENTION

The present invention relates to the field of planar antenna, including the field of the patch antenna, flexible antenna, etc., more particularly it is an antenna oscillator structure.

BACKGROUND OF THE INVENTION

Planar antenna is a novel type antenna structure favored by the consumers due to its thinness, flexibility and space saving advantage. Its basic structure is to arrange distributed antenna oscillator structures on a flexible base board or a base board has certain elasticity. Also bearing certain flexibility or elasticity, the antenna oscillator is a flattened metal structure that can deform along with the deformation of the base board without affecting signal reception.

Since its invention, the technology of planar antenna has become increasingly mature. Planar antenna can be applied to various fields, such as European patent application: EP0274592A1, UK patent application: GB2487391A, Japan patent application: JPS5665502A, United States patent application: U.S. Pat. Nos. 3,261,019A, 3,587,105A, 3,815,141A, United States patent: U.S. Pat. No. 6,429,828B1 etc. However, the technical solutions disclosed in these patent documents are limited to receive single frequency band (e.g. UHF or VHF) or simultaneously receive both UHF and VHF with single frequency reception, incapable of receiving multiple frequencies in the same frequency band, therefore the applications are in some degree constrained.

Another disadvantage exists in prior arts is that the layout of the antenna oscillator is not able to improve the strength of the base board. When in use, the flexible base board will easily deform due to the possible external force such as wind force, and the quality of signal reception is in some degree affected by the structural change of the oscillator caused by the deformation of the base board.

SUMMARY OF INVENTION

The technical problem of the present invention is to overcome the technical inadequacies in the prior arts stated above, and provide an antenna oscillator structure that is able to receive multiple frequencies with a reasonable layout.

Based on the purpose mentioned above, the present invention is carried out through the following technical solutions.

The present invention discloses an antenna oscillator structure, which is mounted on one side of a flattened base board of square shape; the oscillator structure comprises a square frame composed of upper, lower, left and right sides, wherein the middle of the lower side is provided with an opening; two vertical oscillator leads parallel to the left and right sides are symmetrically arranged inside the square frame, The lower ends of the vertical oscillator leads extend to the inner side of the opening to form feeder contacts; the left and right sides of the square frame are provided with a plurality of inwardly extending matching leads connected with the vertical oscillator leads, and the uppermost pair of matching leads are connected to the upper ends of the vertical oscillator. Made of insulating material and approximately in square shape, the flattened square base board, which can have round corner design, is used as a support to arrange the metal antenna oscillator structure on its one side. The metal antenna oscillator structure, which is made of metal tinsel cords with almost identical width, can be arranged at the side of the base board by printing, adherence method and so forth. The feeder contacts connect to a circuit board exists in prior arts; the outer side of the base board can have cladding structure; the outer side of the circuit board can have junction ends that connect to the receiving device such as box, television and so forth.

The present invention employs square frame structure. This structure on the one hand maximizes the reception area, makes signal reception more convenient, and benefits the miniaturization of the entire antenna structure, on the other hand provides a better performance support structure to the whole oscillator structure, preventing the antenna from fracturing during deformation. The characteristic feature of the present invention is the use of multiple pairs of matching leads. One function of the matching leads is to adjust the input impedance of the antenna so that the input impedance of the antenna matches the feeders of the antenna, maximizing the antenna's receiving power. As another function, the multiple pairs of matching leads and the upper part of the closed square frame form a plurality of composite half-wave folded oscillator structures for receiving different frequencies in UHF frequency band; the multiple pairs of matching leads and the lower part of the closed square frame form a plurality of composite half-wave folded oscillator structures for receiving different frequencies in VHF frequency band. In this way, multiple UHF and multiple VHF antenna oscillators are combined into the same antenna structure, the UHF and VHF frequency bands can be divided to correspond to multiple frequencies, which greatly improve the signal receiving ability of the antenna oscillator.

Because the antenna oscillator combines signal reception of multiple frequency bands and multiple frequencies, in order to prevent the received electric signal from interfering with each other in the present invention, above the feeder contacts and below the vertical oscillator leads, the reflection adjustment frames are symmetrically arranged at the two sides of the lower ends of the two vertical oscillator leads. By arranging the structure of the reflection adjustment frames reasonably, the reflection coefficient can be reduced to zero; therefore the power loss caused by the signal interference is avoided. The shape of the reflection adjustment frames can be various kinds of structures; based on the layout of the entire antenna structure, the present invention prefers the reflection adjustment frames are closed frames of triangle, semi-circle or semi-ellipse shape that formed with vertical oscillator leads. These structures are not only convenient for adjustment, reducing the testing times, but also stable when in use, without easily subjecting to the influence caused by the overall deformation of the antenna.

To simplify the structure, reflection adjustment leads symmetrically arranged at the lower two sides of the vertical oscillator leads or below the lowermost pair of matching leads is used to replace the reflection adjustment frame mentioned earlier. The stability of such structure is slightly inferior to the one of reflection adjustment frame, but the structure is simpler and the testing cost is lower.

In order to extend VHF signal length, the lower two sides at both sides of the square frame's opening are inwardly bent. Inwardly bent structure enables the whole half-wave symmetric oscillator structure to be covered inside the square frame, without reaching out the square frame. This guarantee the overall area does not increase. In addition, the inwardly bent structure improves the overall strength of the antenna oscillator structure, possessing greater anti-deformation capability and ensuring the quality of signal reception.

In order to increase the utilization rate of the internal space of the square frame, he lower two sides at both sides of the square frame's opening are inwardly bent in serpentine manner. The structure of inwardly bent in serpentine manner can not only increase the utilization rate of space, but also increase the density of leads arrangement, which is conducive to enhance the overall level of strength.

According to the invention concept stated above, the present invention prefers the following embodiments of antenna oscillator structures.

The first embodiment of the antenna oscillator structure comprises 2~4 pairs of parallel matching leads, the matching leads are distributed horizontally or upward slantingly between the left/right sides of the square frame and the vertical oscillator leads. This type of structure is relatively simple; the use of parallel matching leads structure is advantageous to evenly distribute the intensity of stress on the whole planar antenna oscillator.

The second embodiment is that the first and the second pairs of inwardly extending matching leads arranged at the four corners of the square frame are connected to the upper ends of the vertical oscillator leads, compartmentalizing the square frame into four triangle areas; the third and the fourth pairs of inwardly extending matching leads arranged at the middles of the left/right sides of the square frame are connected to the middles of the first and second pairs of matching leads; the middles of the third and the fourth pairs of matching leads are connected by a "V" shape lead. This structure compounds a plurality of different UHF and VHF antenna oscillator inside same area. The structure is complicated, but through this reasonable layout, even distribution of intensity, greater density of leads arrangement per unit area, and homogenous distribution in all directions overall suggested by mechanics analysis, can be achieved. This structure divides the UHF and VHF frequency bands more specifically, that it has broader application area, better signal reception and signal quality, greater strength and anti-deformation ability.

The third embodiment is that the antenna oscillator structure comprises four pairs of matching leads, the matching leads are distributed in "W" shape between the left/right sides of the square frame and the vertical oscillator leads. Such structure is also a composite of multiple different UHF and VHF antenna oscillators, but the structure is simpler with reasonable layout; it has certain anti-deformation ability.

The fourth embodiment is that it comprises two pairs of matching leads, the matching leads are arranged oppose to each other that present "V" shape structure, forming a hexagon structure with the left/right sides of the square frame and the vertical oscillator leads. Such structure consists of two different UHF and VHF antenna oscillators, the testing of it is simple and convenient; the structure also has reasonable layout and some anti-deformation ability.

The reasonable layout of the planar antenna oscillator on the one hand enhances the anti-deformation capability, on the other hand combines the antenna oscillator structures of different frequency bands and frequencies, which greatly improve the signal receiving ability and receiving quality of the antenna oscillator. The present invention further arranges various kinds of adjustment structure that the receiving power of the antenna is maximized and loss caused by signal interference is reduced. Moreover, the layout of the antenna oscillator is further optimized, enabling further miniaturization and strengthening the antenna after employing such layout. Compared to prior arts, the present invention has substantive features and represents a notable progress.

DESCRIPTION OF PREFERRED EMBODIMENTS

The following examples with figures further specify the present invention. The embodiments and figures mentioned above are not intended to limit the invention. Rather, the drawings and embodiments only serve as demonstrations; for better illustration of the embodiments, some parts in the figures can be amplified or reduced that do not represent the actual scale of the product; for person skilled in the art, it is understandable to omit some of the well-known structures shown in the figures.

Embodiment #1

Figure 1:
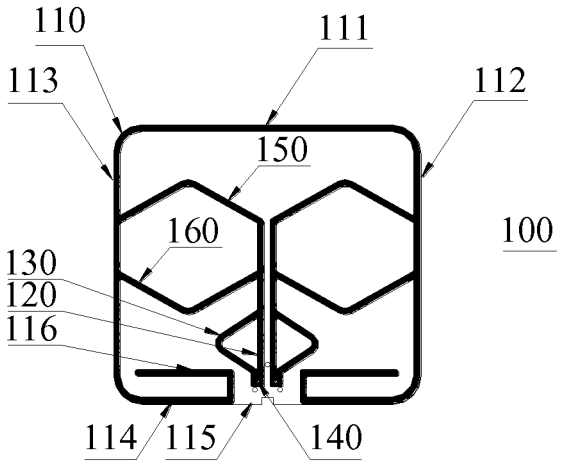
FIG. 1 is the schematic view of the structure of embodiment #1.

FIG. 1 shows an antenna oscillator structure 100, mounted on one side of a flattened base board of square shape. The metal antenna oscillator structure 100, which is made of metal tinsel cords with almost identical width, can be arranged at the side of the base board by printing method. The oscillator structure 100 comprises a square frame 110 composed of upper side 111, lower side 114, left side 113 and right side 112, wherein the middle of the lower side 114 is provided with an opening 115; two vertical oscillator leads 120 parallel to the left side 113 and right side 112 are symmetrically arranged inside the square frame 110, The lower ends of the vertical oscillator leads 120 extend to the inner side of the opening 115 to form feeder contacts 140; above the feeder contacts 140 and below the two vertical oscillator leads 120, the reflection adjustment frames 130 in triangle shape are symmetrically arranged. The left side 113 and right side 112 of the square frame 110 are provided with two inwardly extending matching leads 150,160 connected to the vertical oscillator leads 120, the matching leads 150,160 are arranged oppose to each other that present "V" shape structure, forming a hexagon structure with the left side 113, right side 112 of the square frame 110 and the vertical oscillator leads 120. The lower two sides 114 at both sides of the square frame's opening 115 are inwardly bent fold 116. The feeder contacts 140 connect to a circuit board exists in prior arts, the outer side of the circuit board has junction ends that connect to the receiving devices such as box, television and so forth, which the figure does not show. The base board employs transparent material.

Figure 2:
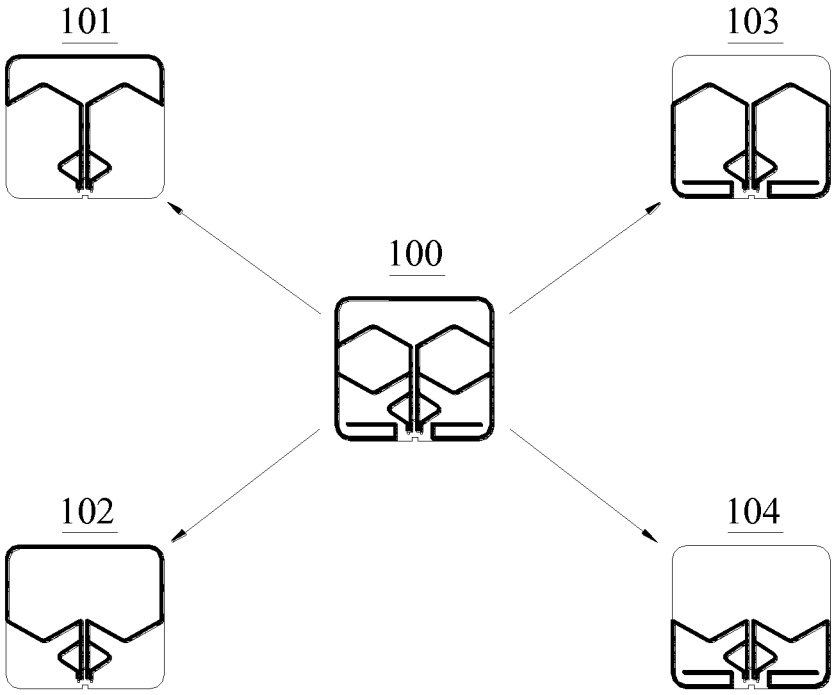
FIG. 2 is the exploded view of the oscillator of embodiment #1.

All constituents of the above mentioned planar antenna oscillator structure 100 form a composite structure of four oscillators, as shown in FIG. 2. The upper side 111, left side 113, the upper part of right side 112, the matching leads 150 and the vertical matching leads 120 construct a half-wave folded oscillator 101 for receiving UHF; the upper side 111, left side 113, the upper part of right side 112, the matching leads 160 and the vertical matching leads 120 construct a half-wave folded oscillator 102 for receiving UHF; the left side 113, lower part of the right side 112, lower side 114, the inwardly bent folded structure 116, the matching leads 150 and the vertical oscillator leads 120 construct a half-wave folded oscillator 103 for receiving VHF; the left side 113, lower part of the right side 112, lower side 114, the inwardly bent folded structure 116, the matching leads 160 and the vertical oscillator leads 120 construct a half-wave folded oscillator 104 for receiving VHF. General UHF signal frequency band is 470~860 MHz, half-wave folded oscillator 101, 102 of different size can further divide this frequency band into two frequency bands. General VHF signal frequency band is 87~230 MHz, half-wave folded oscillator 103, 104 of different size can further divide this frequency band into two frequency bands.

From the analysis stated above, this embodiment further divides the receiving frequency band, each distinct oscillator specifically receives its targeted frequency bands, achieving well targeted signal reception and better quality signal reception.

Embodiment #2

Figure 3:
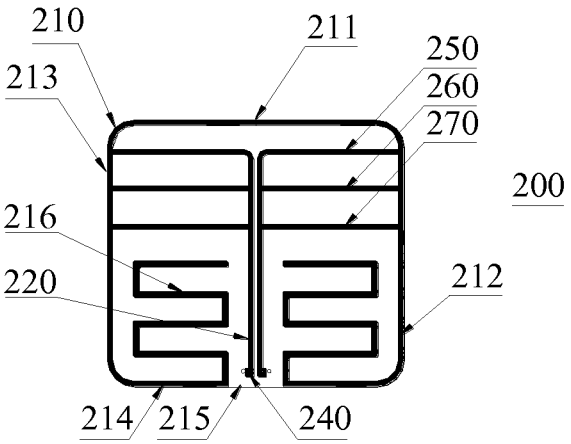
FIG. 3 is the schematic view of the structure of embodiment #2.

As shown in FIG. 3, the oscillator structure 200 comprises a square frame 210 composed of upper side 211, lower side 214, left side 213 and right side 212, wherein the middle of the lower side 214 is provided with an opening 215; two vertical oscillator leads 220 parallel to the left side 213 and right side 212 are symmetrically arranged inside the square frame 210, The lower ends of the vertical oscillator leads 220 extend to the inner side of the opening 215 to form feeder contacts 240. The left side 213 and right side 212 of the square frame 210 are provided with three inwardly extending matching leads 250, 260, 270 connected to the vertical oscillator leads 220, the matching leads 250, 260, 270 mentioned above are arranged horizontally and they parallel to each other. Lower side 214 at both sides of the opening 215 of the square frame 220 inwardly form a serpentine folded structure 216.

Figure 4:
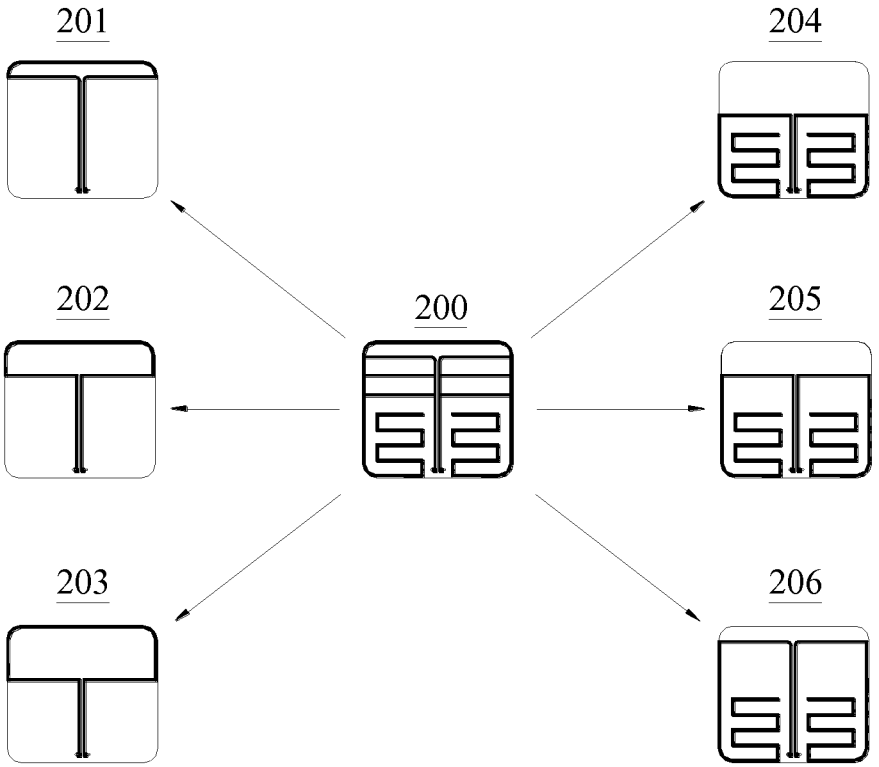
FIG. 4 is the exploded view of the oscillator of embodiment #2.

All constituents of the above mentioned planar antenna oscillator structure 200 form a composite structure of six oscillators, as shown in FIG. 4. The upper side 211, left side 213, the upper part of right side 212, the matching leads 250 and the vertical matching leads 220 construct a half-wave folded oscillator 201 for receiving UHF; the upper side 211, left side 213, the upper part of right side 212, the matching leads 260 and the vertical matching leads 220 construct a half-wave folded oscillator 202 for receiving UHF; the upper side 211, left side 213, the upper part of right side 212, the matching leads 270 and the vertical matching leads 220 construct a half-wave folded oscillator 203 for receiving UHF; the left side 213, lower part of the right side 212, lower side 214, the serpentine folded structure 216, the matching leads 270 and the vertical oscillator leads 220 construct a half-wave folded oscillator 204 for receiving VHF; the left side 213, lower part of the right side 212, lower side 214, the serpentine folded structure 216, the matching leads 260 and the vertical oscillator leads 220 construct a half-wave folded oscillator 205 for receiving VHF; the left side 213, lower part of the right side 212, lower side 214, the serpentine folded structure 216, the matching leads 250 and the vertical oscillator leads 220 construct a half-wave folded oscillator 206 for receiving VHF. General UHF signal frequency band is 470~860 MHz, half-wave folded oscillator 201, 202, 203 of different size can further divide this frequency band into three frequency bands. General VHF signal frequency band is 87~230 MHz, half-wave folded oscillator 204, 205, 206 of different size can further divide this frequency band into three frequency bands.

From the analysis stated above, this embodiment further divides the receiving frequency band, each distinct oscillator specifically receives its targeted frequency bands, achieving well targeted signal reception and better quality signal reception.

Embodiment #3

Figure 5:
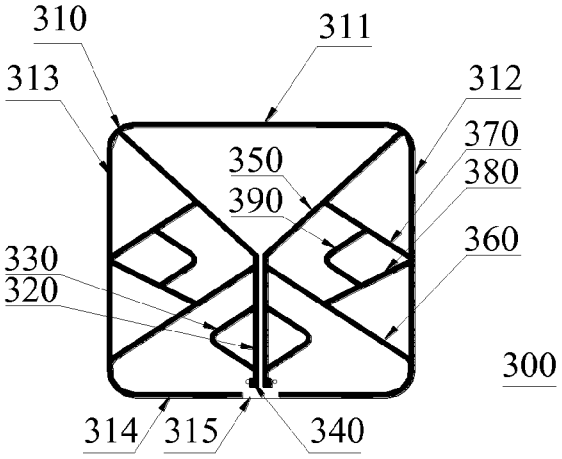
FIG. 5 is the schematic view of the structure of embodiment #3.
Figure 6:
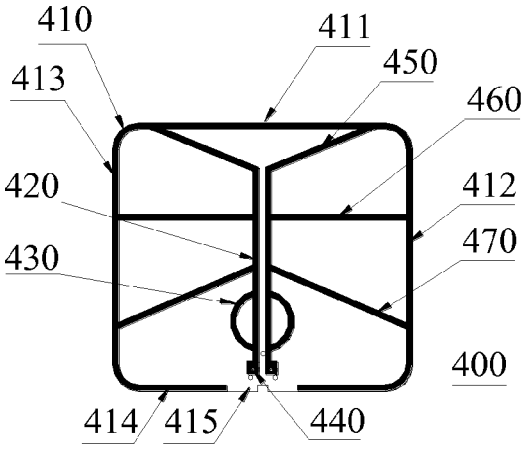
FIG. 6 is the schematic view of the structure of embodiment #4.

As shown in FIG. 5, the oscillator structure 300 comprises a square frame 310 composed of upper side 311, lower side 314, left side 313 and right side 312, wherein the middle of the lower side 314 is provided with an opening 315; two vertical oscillator leads 320 parallel to the left side 313 and right side 312 are symmetrically arranged inside the square frame 310, The lower ends of the vertical oscillator leads 320 extend to the inner side of the opening 315 to form feeder contacts 340. The first pair of inwardly extending matching leads 350 and the second pair of inwardly extending matching leads 360 arranged at the four corners of the square frame are connected to the upper ends of the vertical oscillator leads 320, compartmentalizing the square frame 310 into four triangle areas; the third pair of inwardly extending matching leads 370 and the fourth pair of inwardly extending matching leads 380 arranged at the middles of the left side 313, right side 312 of the square frame 310 are connected to the middles of the first pair of matching leads 350 and the second pair of matching leads 360; the middles of the third pair of matching leads 370 and the fourth pair of matching leads 380 are connected by a "V" shape lead 390. Above the feeder contacts 340 and below the two vertical oscillator leads 320, the reflection adjustment frames 330 in triangle shape are symmetrically arranged.

From the principle mentioned in embodiment #1 and #2, it is known that such structure can further divide the UHF or VHF TV signal frequency band into multiple frequency bands.

Embodiment #4

As shown in FIG. 4, the oscillator structure 400 comprises a square frame 410 composed of upper side 411, lower side 414, left side 413 and right side 412, wherein the middle of the lower side 414 is provided with an opening 415; two vertical oscillator leads 420 parallel to the left side 413 and right side 412 are symmetrically arranged inside the square frame 410, The lower ends of the vertical oscillator leads 420 extend to the inner side of the opening 315 to form feeder contacts 440. The left side 413 and right side 412 of the square frame 410 are provided with three inwardly extending matching leads 450, 460, 470 connected to the vertical oscillator leads 420, the matching leads 450, 460, 470 mentioned above are distributed in fan shape and they do not parallel to each other. Above the feeder contacts 440, the reflection adjustment frame 430 in semi-circle shape is symmetrically arranged at the two sides of the lower ends of the two vertical oscillator leads 420.

From the principle mentioned in embodiment #1 and #2, it is known that such structure can further divide the UHF or VHF TV signal frequency band into three frequency bands.

Embodiment #5

Figure 7:
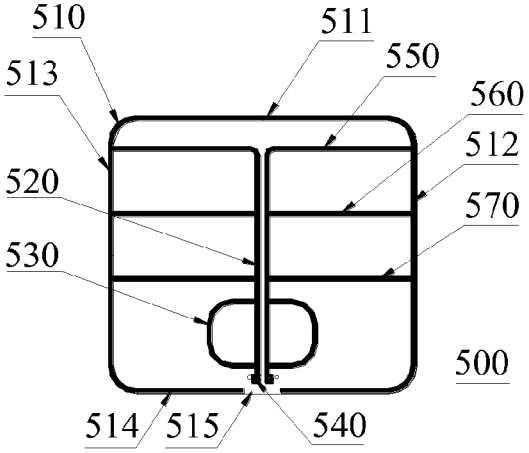
FIG. 7 is the schematic view of the structure of embodiment #5.

As shown in FIG. 7, the oscillator structure 500 comprises a square frame 510 composed of upper side 511, lower side 514, left side 513 and right side 512, wherein the middle of the lower side 514 is provided with an opening 515; two vertical oscillator leads 520 parallel to the left side 513 and right side 512 are symmetrically arranged inside the square frame 510, The lower ends of the vertical oscillator leads 520 extend to the inner side of the opening 515 to form feeder contacts 540. The left side 513 and right side 512 of the square frame 510 are provided with three inwardly extending matching leads 550, 560, 470 connected to the vertical oscillator leads 420, the matching leads 450, 460, 570 mentioned above are arranged horizontally and parallel to each other. Above the feeder contacts 540, the reflection adjustment frame 530 is symmetrically arranged at the two sides of the lower ends of the two vertical oscillator leads 520.

From the principle mentioned in embodiment #1 and #2, it is known that such structure can further divide the UHF or VHF TV signal frequency band into three frequency bands.

Embodiment #6

Figure 8:
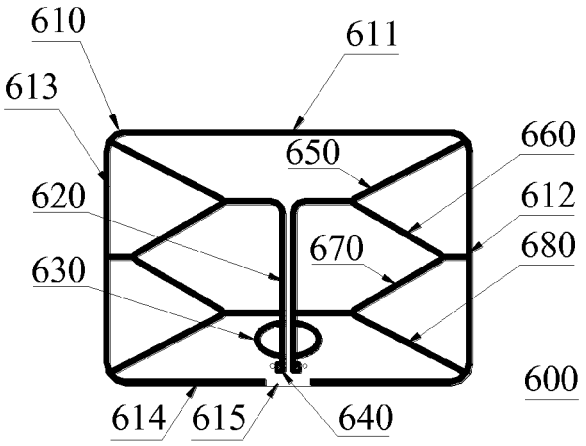
FIG. 8 is the schematic view of the structure of embodiment #6.

As shown in FIG. 8, the oscillator structure 600 comprises a square frame 610 composed of upper side 611, lower side 614, left side 613 and right side 612, wherein the middle of the lower side 614 is provided with an opening 615; two vertical oscillator leads 620 parallel to the left side 613 and right side 612 are symmetrically arranged inside the square frame 610, The lower ends of the vertical oscillator leads 620 extend to the inner side of the opening 615 to form feeder contacts 640. This structure comprises four pairs of matching leads 650, 660, 670, 680, the matching leads 650, 660, 670, 680 are distributed in "W" shape between the left side 613 and right side 612 of the square frame and the vertical oscillator leads 620.

From the principle mentioned in embodiment #1 and #2, it is known that such structure can further divide the UHF or VHF TV signal frequency band into four frequency bands.

Embodiment #7

Figure 9:
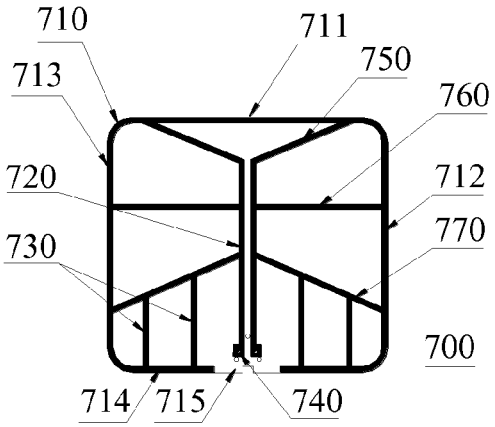
FIG. 9 is the schematic view of the structure of embodiment #7.

As shown in FIG. 9, the oscillator structure 700 comprises a square frame 710 composed of upper side 711, lower side 714, left side 713 and right side 712, wherein the middle of the lower side 714 is provided with an opening 715; two vertical oscillator leads 720 parallel to the left side 413 and right side 712 are symmetrically arranged inside the square frame 710, The lower ends of the vertical oscillator leads 720 extend to the inner side of the opening 715 to form feeder contacts 740. The left side 713 and right side 712 of the square frame 710 are provided with three inwardly extending matching leads 750, 760, 770 connected to the vertical oscillator leads 720, the matching leads 750, 760, 770 mentioned above are distributed in fan shape and they do not parallel to each other. Between the matching leads 770 and the lower side 714, there are two pairs of reflection adjustment leads 730 with different length.

From the principle mentioned in embodiment #1 and #2, it is known that such structure can further divide the UHF or VHF TV signal frequency band into three frequency bands.

Embodiment #8

Figure 10:
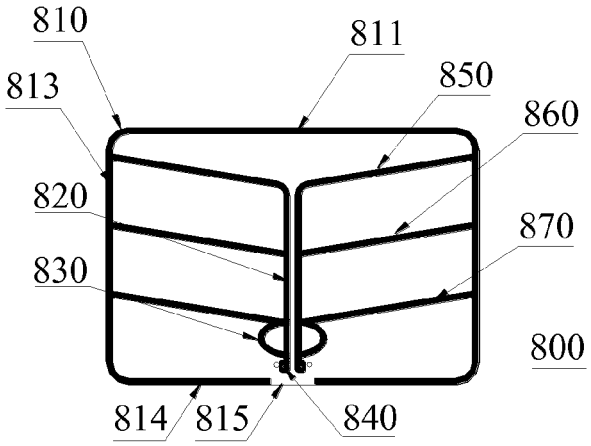
FIG. 10 is the schematic view of the structure of embodiment #8.

As shown in FIG. 10, the oscillator structure 800 comprises a square frame 810 composed of upper side 811, lower side 814, left side 813 and right side 812, wherein the middle of the lower side 814 is provided with an opening 815; two vertical oscillator leads 820 parallel to the left side 813 and right side 812 are symmetrically arranged inside the square frame 810, The lower ends of the vertical oscillator leads 820 extend to the inner side of the opening 815 to form feeder contacts 840. The left side 813 and right side 812 of the square frame 810 are provided with three inwardly extending matching leads 850, 860, 870 connected to the vertical oscillator leads 820, the matching leads 850, 860, 870 mentioned above are arranged upward slantingly and paralleled to each other. Above the feeder contacts 840, the reflection adjustment frame 830 in semi-ellipse shape is symmetrically arranged at the two sides of the lower ends of the two vertical oscillator leads 820.

From the principle mentioned in embodiment #1 and #2, it is known that such structure can further divide the UHF or VHF TV signal frequency band into three frequency bands.

Embodiment #9

Figure 11:
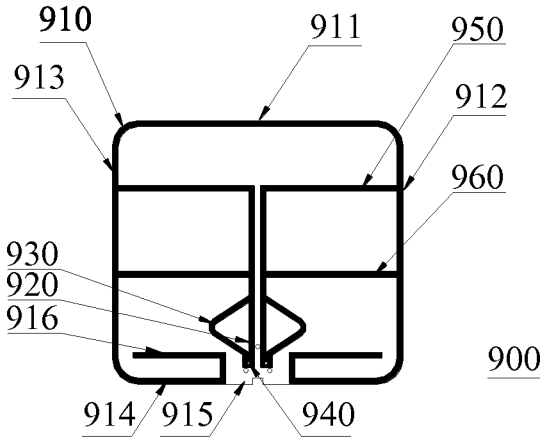
FIG. 11 is the schematic view of the structure of embodiment #9.

This embodiment is the simplest principle structure embodiment of the embodiments stated above. As shown in FIG. 11, an antenna oscillator structure 900 comprises a square frame 910 composed of upper side 911, lower side 914, left side 913 and right side 912, wherein the middle of the lower side 914 is provided with an opening 915; two vertical oscillator leads 920 parallel to the left side 913 and right side 912 are symmetrically arranged inside the square frame 910, The lower ends of the vertical oscillator leads 920 extend to the inner side of the opening 915 to form feeder contacts 940; above the feeder contacts 940 and below the two vertical oscillator leads 920, the reflection adjustment frames 930 in triangle shape are symmetrically arranged. The left side 913 and right side 912 of the square frame 910 are provided with two inwardly extending matching leads 950,960 connected to the vertical oscillator leads 920, the matching leads 950,960 are arranged horizontally and paralleled to each other. The lower two sides 914 at both sides of the square frame's opening 915 are inwardly bent fold 916.

Figure 12:
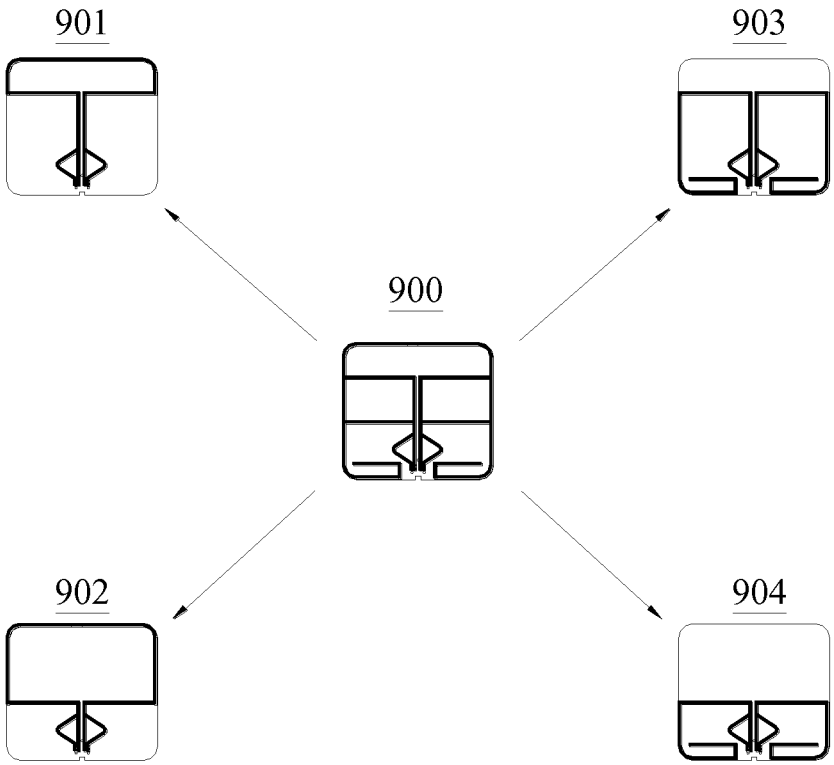
FIG. 12 is the exploded view of the oscillator of embodiment #9.

All constituents of the above mentioned planar antenna oscillator structure 900 form a composite structure of four oscillators, as shown in FIG. 12. The upper side 911, left side 913, the upper part of right side 912, the matching leads 950 and the vertical matching leads 920 construct a half-wave folded oscillator 901 for receiving UHF; the upper side 911, left side 913, the upper part of right side 912, the matching leads 960 and the vertical matching leads 920 construct a half-wave folded oscillator 902 for receiving UHF; the left side 913, lower part of the right side 912, lower side 914, the inwardly bent folded structure 916, the matching leads 950 and the vertical oscillator leads 920 construct a half-wave folded oscillator 903 for receiving VHF; the left side 913, lower part of the right side 912, lower side 914, the inwardly bent folded structure 916, the matching leads 960 and the vertical oscillator leads 920 construct a half-wave folded oscillator 904 for receiving VHF. General UHF signal frequency band is 470~860 MHz, half-wave folded oscillator 901, 902 of different size can further divide this frequency band into two frequency bands. General VHF signal frequency band is 87~230 MHz, half-wave folded oscillator 903, 904 of different size can further divide this frequency band into two frequency bands.

From the analysis stated above, this embodiment further divides the receiving frequency band, each distinct oscillator specifically receives its targeted frequency bands, achieving well targeted signal reception and better quality signal reception.

The following examples with figures further specify the present invention. The embodiments and figures mentioned above are not intended to limit the invention. Apparently, the embodiments of present invention are only used as examples to illustrate the invention clearly, not to limit the implementation method of the present invention. Person skilled in the art can make changes to the present invention in different forms based on the illustration above. Here it is not necessary and possible to exhaustively list all the embodiments. Any alterations, equal replacement and improvement etc. within the principle and spirit of present invention, should be fallen into the protection scope of the claims of present invention.

What is claimed is:

1. An antenna oscillator structure, which is mounted on one side of a flattened base board of square shape, wherein the antenna oscillator structure comprises a square frame composed of leads provided along upper, lower, left and right sides, wherein a middle of the lower side is provided with an opening; two vertical oscillator leads parallel to the left and right sides are symmetrically arranged inside the square frame, lower ends of the vertical oscillator leads extend to the opening to form feeder contacts; and the left and right sides of the square frame are provided with a plurality of inwardly extending matching leads connected with the vertical oscillator leads.

2. The antenna oscillator structure according to claim 1, wherein above the feeder contacts, reflection adjustment frames are symmetrically arranged at outer sides of the lower ends of the two vertical oscillator leads.

3. The antenna oscillator structure according to claim 2, wherein the reflection adjustment frames are closed frames of triangle, semi-circle or semi-elliptical shape that are formed off of the vertical oscillator leads.

4. The antenna oscillator structure according to claim 2, wherein the reflection adjustment frames are arranged below the plurality of matching leads.

5. The antenna oscillator structure according to claim 1, wherein on either side of the opening, a portion of the lower side is provided, said portions being inwardly bent.

6. The antenna oscillator structure according to claim 5, wherein said portions on either side of the opening are inwardly bent in a serpentine manner.

7. The antenna oscillator structure according to claim 1, wherein the plurality of matching leads comprises 2~4 pairs of parallel matching leads, and wherein the matching leads are distributed horizontally or upward slantingly between the left/right sides of the square frame and the vertical oscillator leads.

8. The antenna oscillator structure according to claim 1, wherein the plurality of matching leads comprises first, second, third, and fourth pairs of matching leads, and wherein the first and the second pairs of inwardly extending matching leads arranged at four corners of the square frame are connected to the upper ends of the vertical oscillator leads, compartmentalizing the square frame into four triangular areas; the third and the fourth pairs of inwardly extending matching leads are arranged at middles of the left/right sides of the square frame and are connected to middles of the first and second pairs of matching leads; and middles of the third and the fourth pairs of matching leads are connected by a "V" shaped lead.

9. The antenna oscillator structure according to claim 1, wherein the plurality of matching leads comprises four pairs of matching leads, and the matching leads are distributed in a "W" shape between the left/right sides of the square frame and the vertical oscillator leads.

10. The antenna oscillator structure according to claim 1, wherein the plurality of matching leads comprises two pairs of matching leads, the matching leads are arranged oppose to each other to form a "V" shaped structure, thereby forming a hexagon structure with the left/right sides of the square frame and the vertical oscillator leads.

* * * * *